US005623130A

United States Patent [19]

Noxon

[11] Patent Number: 5,623,130

[45] Date of Patent: Apr. 22, 1997

[54] SYSTEM FOR ENHANCING ROOM ACOUSTICS

[76] Inventor: Arthur M. Noxon, P.O. Box 1189, Eugene, Oreg. 97440

[21] Appl. No.: 559,830

[22] Filed: Nov. 20, 1995

[51] Int. Cl.[6] ..... E04B 1/99

[52] U.S. Cl. ..... 181/30

[58] Field of Search ..... 181/30, 295, 286, 181/288, 290, 294

[56] References Cited

U.S. PATENT DOCUMENTS

| | | | |
|---|---|---|---|
| 3,421,273 | 1/1969 | Eckel | 181/295 |
| 3,786,898 | 1/1974 | Fujii | 181/295 |
| 3,857,459 | 12/1974 | Adams et al. | 181/295 |
| 4,362,222 | 12/1982 | Hellstrom | 181/30 |
| 5,035,298 | 7/1991 | Noxon | 181/295 |

*Primary Examiner*—Khanh Dang
*Attorney, Agent, or Firm*—James D. Givnan, Jr.

[57] ABSTRACT

A system utilizing a series of sound absorbant baffles which are spaced along intersecting wall and ceiling surfaces of a room or alternatively entirely on a wall surface to absorb sound waves moving in an oblique manner to the surfaces. The baffles are of a low density material with faces projecting from the wall and ceiling surfaces. Sealant applied to baffle edges ensures gap free securement to wall and ceiling surfaces. The baffles do not significantly interfere with sound moving perpendicular to the wall and ceiling surfaces to preserve desired acoustical characteristics of a room. Mounting brckets including clips may be provided for attaching the baffles to room surfaces in a removable manner.

8 Claims, 2 Drawing Sheets

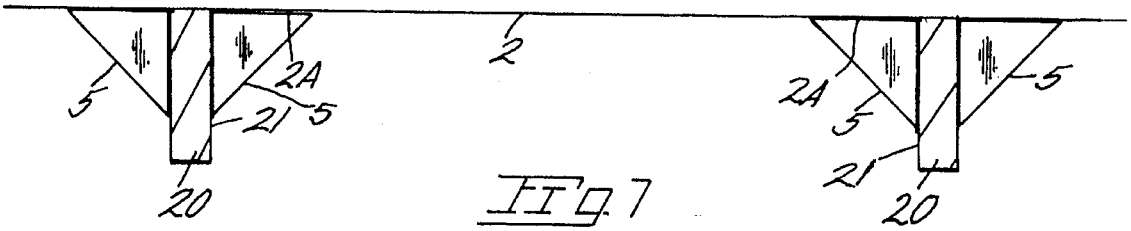
FIG. 7
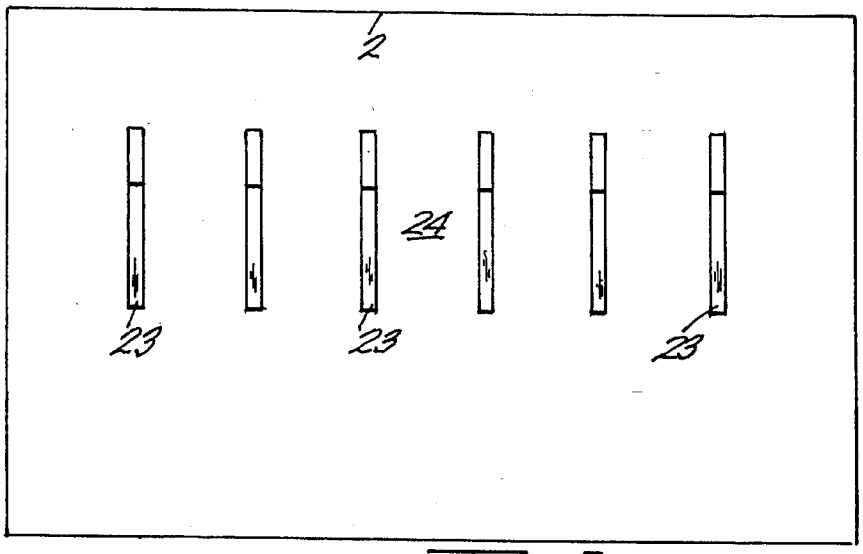
FIG. 8
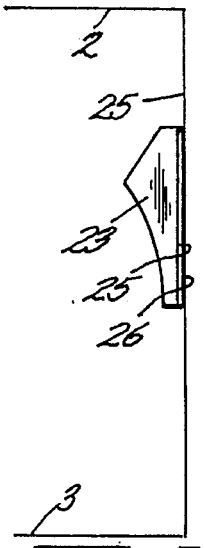
FIG. 9
FIG. 11
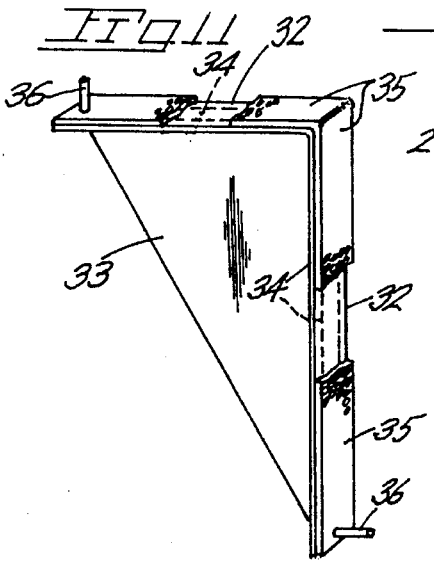
FIG. 10
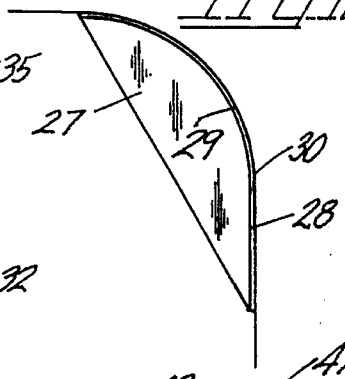
FIG. 12
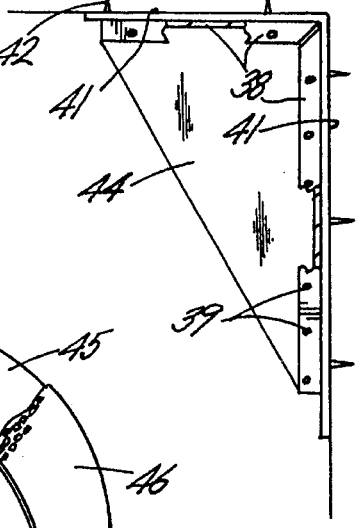
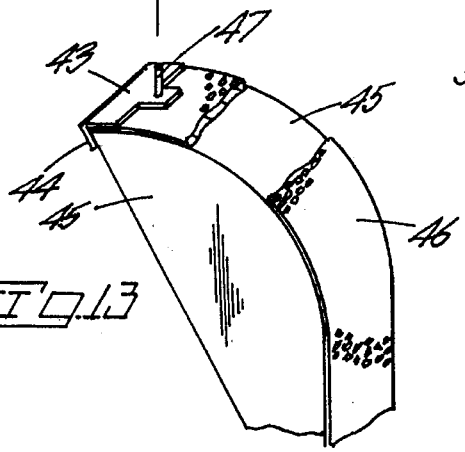
FIG. 13

SYSTEM FOR ENHANCING ROOM ACOUSTICS

BACKGROUND OF THE INVENTION

The present invention concerns generally the modification of room wall and ceiling structures to inhibit those sound waves detracting from room acoustics.

Attempts to alter room acoustics include the provision of floor and ceiling components intended to absorb sound waves to diminsh room noise. Also known are sound absorbant wall panels for placement on room walls. Such efforts do succeed in reducing room noise but ignore the impact on room acoustics., i.e., both directly reflected sound waves and circulating sound waves or reverberations are limited to cause a reduction in the acoustical brightness of a room.

U.S. Pat. No. 4,362,222 shows the use of a sound absorbant structure, plate or panel, for example mineral wool, extending upwardly in an inclined manner from a room wall for attachment to the ceiling of the room. A volume of air is trapped behind the sound absorbant structure.

U.S. Pat. No. 5,035,298 discloses the use of elongate structures of sound absorptive material in place horizontally along wall and ceiling intersections and in an upright manner in room corners.

SUMMARY OF THE PRESENT INVENTION

The present invention is embodied within the provision of a multitude of sound absorbant members which project into a room area adjacent sound reflective surfaces for the absorbing of those sound waves moving obliquely relative said surfaces.

Acoustical brightness of a room is directly related to the reflection of sound waves along paths normal to wall and ceiling surfaces while circulatory sound waves or reverberations interfere with and tend to degrade same. It has been determined that circulatory sound waves may be attenuated by the strategic placing of sound absorbant members in an unobtrusive manner along room surfaces and particularly along the surfaces of wall and ceiling intersections. Suitable sound absorbant members for present purposes are edge mounted on room wall structures and may be of a fibrous nature such as a compressed fibre having a density of 5 pounds per cubic foot or so with a sealant to preclude the existance of gaps between the member and supporting room structure.

The sound absorbant members are utilized in a series disposed along room surfaces with the members disposed in a projecting manner to receive both direct and wall reflected sound waves to effectively reduce same while avoiding a like reduction in sound and reflected sound moving perpendicular to the surface of a room wall or other surface. Of particular advantage is the positioning of such members at the intersection of wall and ceiling surfaces or ceiling and beam surfaces where circulatory sound waves are normally reflected in an oblique manner.

Important objectives of the present invention include the provision of sound absorbant members having an edge surface suitable for the reception of a sealant to enable attachment of the members to a room structure surface to provide a series of projecting sound baffles in gap free placement on said surface; the provision of sound absorbant members lending themselves to placement on intersecting room surfaces to absorb circulatory sound waves reflected in an oblique manner from the intersecting room surfaces; the provision of highly absorbant light weight sound baffles supported by brackets including clips for spaced apart placement along room structures without costly or permanent alteration of such structures.

BRIEF DESCRIPTION OF THE DRAWINGS

In the drawings:

FIG. 7 is a vertical sectional view of a room ceiling having exposed beams extending thereacross with ceiling and beam supported sound baffles of the present system;

FIG. 8 is a vertical sectional view of a room wall equipped with a series of sound absorbant members or baffles;

FIG. 9 is an elevational view taken from the right side of FIG. 8;

FIG. 10 is a vertical sectional view of a room wall/ceiling intersection with a sound barrier in place thereon;

FIG. 11 is a perspective view of mounting means supporting a baffle;

FIG. 12 is an elevational view of a baffle in place in a mounting bracket; and FIG. 13 is a fragmentary perspective view of a baffle supported in place by clip mounting means.

DETAILED DESCRIPTION OF THE PREFERRED EMBODIMENTS

Figure 1:
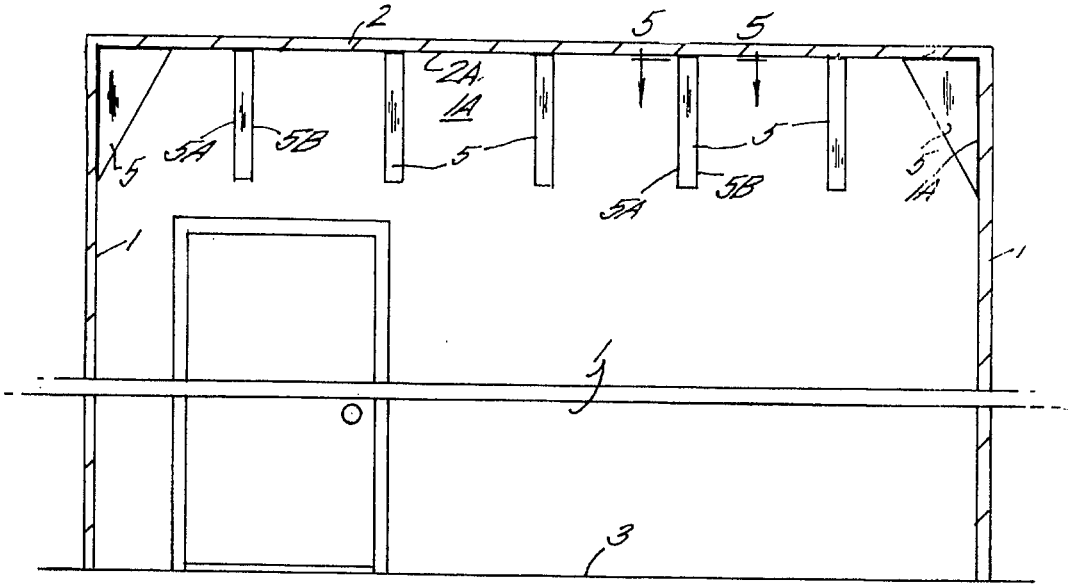
FIG. 1 is a vertical sectional view of a room equipped with the present system.
Figure 2:
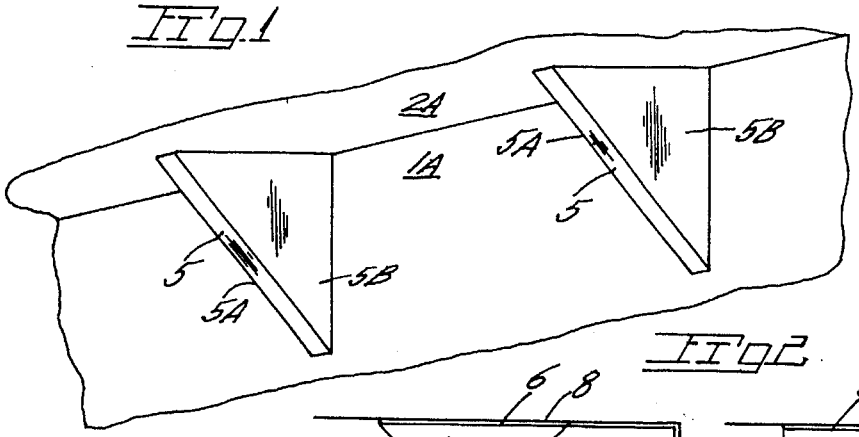
FIG. 2 is a fragmentary perspective view of a wall and ceiling intersection with sound absorbant baffles in place.
Figure 3:
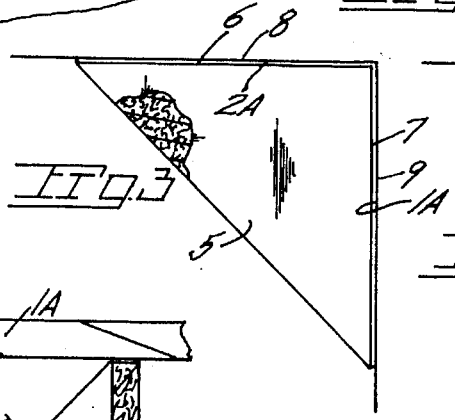
FIGS. 3 and 4 are elevational views of sound baffles of different configurations.
Figure 4:
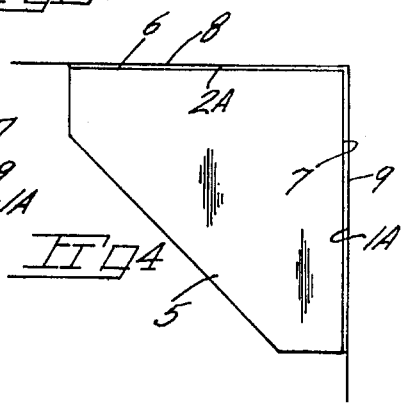

With continuing attention to the drawings wherein the reference numeral 1 indicates wall structures of a room having a ceiling structure at 2 and a floor at 3. An unseen remaining wall structure of the room would be a mirror image of the wall structure shown in FIG. 1.

With reference to FIGS. 1–4, sound absorbant members or baffles are shown at 5 each with side walls 5A–5B and arranged in series at spaced intervals along wall and ceiling adjacent surfaces at 1A and 2A. Spacing of the members may, in a typical room in an office or home, be spaced on the order of two feet or so.

Sound absorbant member or baffle 5 has horizontal and vertical edge surfaces at 6 and 7 on which a quantity of sealant at 8 and 9 is received to provide a continuous barrier to provide gap free attachment to adjacent wall and ceiling surfaces 1A–2A. A suitable sealant may be an adhesive of the type provided in the form of tubular containers. Typically baffle 5 has a greater vertical dimension than horizontal dimension.

A suitable material for the sound absorbing members is HVAC acoustical board typically 3–5 lbs/ft$^3$ and may be of compressed fibrous material such as wood fibre or hair or cellular acoustical foam and approximately two inches thick. While specific shapes are shown in the drawings it will be understood that a variety of shapes and sizes may be satisfactory with due consideration given to room aesthetics.

Figure 5:
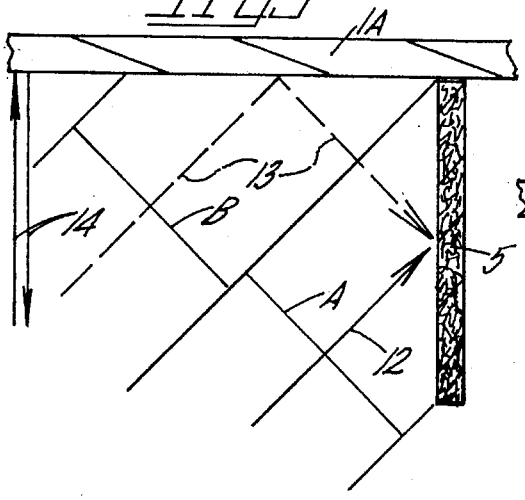
FIG 5. is a horizontal sectional view taken along line 5—5 of FIG. 1.

FIG. 5 shows, in schematic manner, how both direct and reflected sound at A and B are absorbed. Sound wave vectors are at 12 and 13 with the latter representing sound waves reflected by wall 1. Accordingly both sets of sound waves are substantially attenuated and hence circulatory wave energy in a room is greatly diminished. The foregoing is accomplished with but only light attenuation of those sound waves moving toward and reflected from room structure normal along vectors perpendicular to the structure as at 14 in FIG. 5.

Figure 6:
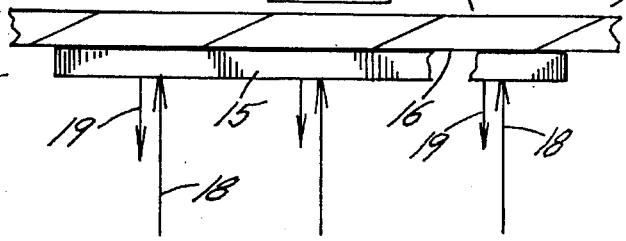
FIG. 6 (PRIOR ART)
FIG. 6 is a horizontal sectional view of a wall equipped with a prior art noise absorbant wall panel.

For purposes of comparison, in FIG. 6 a prior art noise absorbant planar wall panel is at 15 supported in place on a wall surface 16. Such panels are often several feet in length and overlie a large area (several square feet) of a room wall to greatly reduce acoustical brightness of the room in that sound moving in a path normal to wall surface 16 is substantially diminished as represented by the different length sound vectors at 18 and 19.

The present system may be utilized in a room having secondary wall surfaces such as those indicated at 21 in FIG. 7 wherein the secondary wall surfaces are on ceiling beams 20. An intersecting ceiling surface area is at 2A. Accordingly use of the present system is not restricted to installation on intersecting room wall and ceiling surface areas proper.

In FIG. 8 room acoustics are enhanced by the installation of sound absorbant baffles 23 entirely in place on a wall surface 24. The sound absorbant member or baffle may be of various shapes with an edge surface area at 25 provided with an adhesive sealant at 26. The sound baffles 23, shown offset below a ceiling 2, reduces their effectiveness however for the reason that sound reflected downward in an oblique manner from the ceiling is less apt to encounter a baffle offset from the ceiling.

In FIG. 10 the present sound absorbant member or baffle 27 is provided with an edge surface area 28 shaped to suit the contour of the wall/ceiling intersection embodied in a curved surface 29. A sealant is at 30.

In FIGS. 11, 12 and 13 various mounting arrangements are provided for sound absorbant members. In FIG. 11 a bracket 32 is of a lightweight plastic and retains a sound absorbant member 33 in place by an adhesive at 34. A sound barrier at 35, such as cellular foam, provides a gap free placement against wall and ceiling surfaces. Fasteners at 36 attach the bracket to room surfaces.

In FIG. 12 a bracket 38, preferably of metal, is of channel shape in cross section with a sound absorbant member 44 seated in the bracket channel and held in place by retainers as at 39. A sound barrier at 41 may be caulking material or other mastic. Bracket 38 is attached to room wall surfaces by suitable fasteners as at 42.

In FIG. 13 a still further mounting arrangement is shown ultilizing clips, one of which is indicated at 43, which have a lip 44 which abuts a surface of a sound absorbant member 45. A sound barrier is embodied in a stip of cellular foam material 46 applied to absorbant member 45 prior to installation of said member intermediate a pair of clips 43 held in place by fasteners as at 47.

While I have shown but a few embodiements of the invention, it will be apparent to those skilled in the art that the invention may be embodied still otherwise without departing from the spirit and scope of the invention.

Having thus described the invention, what is desired to be secured by a Letters Patent is:

I claim:

1. A system for enhancing the acoustics of a room having wall and ceiling structures by attenuation of sound waves traveling in paths oblique to surfaces of said structures, said system including, a series of spaced apart sound absorbent members, each of said members having an edge surface and oppositely disposed faces, said faces normal to and terminating at said edge surface, and a sealant on the edge surface of each of said members for contact with at least one of said structures, said absorbent members for disposition at spaced intervals along and with the faces thereof disposed normal to at least one of said structures.

2. The system claimed in claim 1 wherein said oppositely disposed faces of said sound absorbent members each terminate at an additional edge surface, said additional edge surface for sealant reception enabling attachment of the sound absorbent members to both wall and ceiling structures in a gap free manner.

3. A system for enhancing the acoustics of a room having a ceiling and upright walls by attenuation of circulatory sound waves, said system including, sound absorbent baffles each having mutually perpendicular horizontal and vertical edge surfaces, an adhesive sealant on said horizontal and vertical edge surfaces, said baffles located at spaced intervals in a row with their horizontal and vertical edge surfaces supported by ceiling and wall surfaces and held in place by said sealant, each of said baffles having faces disposed normal to the horizontal and the vertical edge surfaces of each of said baffles, and said sound absorbent baffles effective to attenuate circulating sound waves moving in an oblique path relative said ceiling and upright walls while avoiding attenuation of sound waves moving in a path normal to said ceiling and upright walls.

4. A system for enhancing the acoustics of a room having wall and ceiling structures by attenuation of sound moving along a path oblique to said structures, said system including, a series of spaced apart sound absorbent members each having an edge surface and oppositely disposed faces terminating at said edge surface, mounting means engageable with said edge surface of each of said sound absorbent members for attaching said absorbent members to one or both of said structures, a sound barrier for disposition between said mounting means and at least one of said wall and ceiling structures, and means for fastening said mounting means to said one of said structures.

5. The system claimed in claim 4 wherein said mounting means is a bracket and said sound barrier is of cellular foam construction.

6. The system claimed in claim 4 wherein said mounting means is a bracket of channel cross section.

7. The system claimed in claim 6 wherein said sound barrier is a mastic.

8. The system claimed in claim 4 wherein said mounting means are clips for spaced apart engagement with each of said sound absorbent members.

* * * * *